US007963894B2

(12) United States Patent
Hanspall et al.

(10) Patent No.: US 7,963,894 B2
(45) Date of Patent: Jun. 21, 2011

(54) APPARATUS AND METHOD FOR EXERCISING ABDOMINAL MUSCLES

(76) Inventors: Ashley Hanspall, Trumpington (GB); Thomas Dann, Duxford (GB)

( * ) Notice: Subject to any disclaimer, the term of this patent is extended or adjusted under 35 U.S.C. 154(b) by 0 days.

(21) Appl. No.: 12/094,649

(22) PCT Filed: Nov. 21, 2006

(86) PCT No.: PCT/GB2006/004317

§ 371 (c)(1),
(2), (4) Date: Jul. 18, 2008

(87) PCT Pub. No.: WO2007/060401

PCT Pub. Date: May 31, 2007

(65) Prior Publication Data

US 2008/0293553 A1 Nov. 27, 2008

(30) Foreign Application Priority Data

Nov. 26, 2005 (GB) ..... 0524146.8
May 4, 2006 (GB) ..... 0608767.0

(51) Int. Cl.
*A63B 26/00* (2006.01)

(52) U.S. Cl. ..... 482/140

(58) Field of Classification Search ..... 482/140, 482/148, 1–9, 139, 62, 91, 51, 77, 26–32, 482/35; 473/197, 422, 447, 479; 434/248, 434/251; 472/93–94, 137; 5/449; 446/220.1; 441/40

See application file for complete search history.

(56) References Cited

U.S. PATENT DOCUMENTS

| | | | | |
|---|---|---|---|---|
| 5,125,883 | A | 6/1992 | Shoebrooks | |
| 6,280,367 | B1 * | 8/2001 | Arsenault | 482/140 |
| 2002/0132703 | A1 * | 9/2002 | Martinez et al. | 482/8 |
| 2005/0124474 | A1 * | 6/2005 | Van Der Hoeven | 482/140 |

FOREIGN PATENT DOCUMENTS

| | | | |
|---|---|---|---|
| GB | 2270004 | A | 3/1994 |
| WO | WO-02/37732 | A2 | 5/2002 |
| WO | WO-03/084618 | A | 10/2003 |
| WO | WO 03/084618 | A1 | 10/2003 |

* cited by examiner

*Primary Examiner* — Lori Baker
(74) *Attorney, Agent, or Firm* — Barnes & Thornburg LLP

(57) ABSTRACT

Disclosed is apparatus for exercising the abdominal muscles, comprising: a control means, a visual display having a plurality of elements each of which is capable of individual illumination responsive to signals from the control means, and detection means for detecting a hand or part thereof placed in proximity to an illuminated one of the plurality elements, the illuminated element being returned to a non-illuminated state in response to; (c) detection by the detection means of a hand or part thereof in proximity to the illuminated element; and/or (d) a signal from the control means which is emitted after the element has been illuminated for a predetermined length of time; the apparatus enabling a user to lie in front of the display, sit up as each element is illuminated, place a hand in proximity to the illuminated element and then return to the lying position, ready for the next sit-up.

7 Claims, 2 Drawing Sheets

APPARATUS AND METHOD FOR EXERCISING ABDOMINAL MUSCLES

FIELD OF THE INVENTION

This invention relates to apparatus for and a method of exercising abdominal muscles.

BACKGROUND OF THE INVENTION

The invention was devised to overcome the tedium typically associated with performing repetitive abdominal exercises (i.e. sit-ups) using known exercise machines.

U.S. Pat. No. 6,299,570 discloses an exercise device comprised of light cylindrical and curved components. The device may be used to strengthen abdominal muscles, external and internal obliques, anterior deltoids and serratus anterior using basketballs. GB 2,270,004 concerns an exercise device comprising a plurality of target members which may be struck by a player in a playing sequence.

SUMMARY OF THE INVENTION

According to one aspect of the invention apparatus for exercising the abdominal muscles comprises control means, a visual display having a plurality of elements each of which is capable of individual illumination responsive to signals from the control means, and detection means for detecting a hand or part thereof placed in proximity to an illuminated one of the plurality elements, the illuminated element being returned to a non-illuminated state in response to (a) detection by the detection means of a hand or part thereof in proximity to the illuminated element, and/or (b) a signal from the control means which is emitted after the element has been illuminated for a predetermined length of time, the apparatus enabling a user positioned in front of the display, to perform a sit-up as each element is illuminated, place a hand in proximity to the illuminated element and then return to the initial position, ready for the next sit-up. Thus, the illumination of an element may prompt the user to commence a sit-up and then typically encourages the user to finish the sit-up by extinguishing the illuminated element, introducing interest and encouragement into the exercise routine.

For the purposes of the present specification, "abdominal exercise" means, especially, a "sit-up" exercise performed by a user. Typically in a sit-up the user may initally be either seated or in a prone position on their back. The sit-up exercise involved, in either instance, moving the torso towards the thighs by contraction of the abdominal muscles, with or without additional twisting movement provided by contraction of the oblique abdominal muscles.

Preferably, the apparatus of the present invention comprises a foot-retaining means to hold the feet of the user in place during exercise. The foot-retaining means may comprise one or two footholds, which may, for example, take the form of one or two bars (preferably padded) under which the feet of the user can be placed, or one or two (preferably adjustable) straps to hold the feet of the user in place, or shaped or moulded recesses in a foot-retaining member to accommodate the feet of the user.

Preferably the illuminated element is extinguished in response to the proximity of the user's hand or part thereof to the illuminated element.

Preferably, the control means comprises control circuitry which controls the illumination of the elements such that they are illuminated in a random sequence which introduces an uncertainty that further adds interest for the user.

In those embodiments in which the illuminated element is extinguished in response to the proximity of the user's hand or part thereof, the apparatus is preferably capable of determining the elapsed time between the onset of illumination of each element and the placing of the user's hand or part thereof in proximity to the illuminated element, comparing the elapsed time with a predetermined allowed time interval and, if the elapsed time is less than the predetermined allowed time interval, according a score so that the accumulated score is representative of the total number of times that the user has completed a sit-up within the predetermined time. As the exercise progresses, the accumulated score may be displayed to the user, for example on an alpha-numeric display which may, if desired form part of said visual display.

The illuminated element may be a simple light or abstract image, or may take the form of a recognisable shape, object, person etc.

The term "in proximity" as used herein, encompasses the hand of the user actually touching an element, and typically entails the user's hand or part thereof coming within 5 cm of the element, preferably within 3 cm, and most preferably within 1 cm of the element. The proximity of a user's hand or part thereof (such as one or more digits) to an illuminated element may be detected in any of a number of ways. In one embodiment, in addition to being capable of illumination, each element may be touch-sensitive, delivering to the control circuit an electric signal when touched by the user's hand. In some embodiments, the proximity of the user's hand could be detected capacitatively, or by optical means (e.g. the user's hand interrupting a light beam passing across the face of the element between a source and a detector).

In some embodiments, the apparatus comprises a touch-sensitive screen or monitor. Preferably such a touch-sensitive screen will be a resistive or capacitative-based screen.

If desired the apparatus may also emit audible sounds e.g. when programming the apparatus exercise intensity, and/or each time an illuminated element is extinguished within the permitted time interval (and perhaps a different sound if this is not achieved), and a signal when the exercise regime has been completed.

The apparatus preferably includes the facility to vary the intensity of the exercise, for example by altering the frequency of illumination of the elements or by varying the predetermined time interval, it being understood that a shorter predetermined time interval corresponds to a greater level of intensity of exercise.

If the user succeeds in extinguishing the illuminated element within a predetermined time from the onset of its illumination, the apparatus preferably registers this as a positive result by, for example, incrementing a stored score which is preferably displayed to the user so that the user can monitor his or her progress during exercise. The elements are preferably illuminated in a sequence of a predetermined total number, e.g. 100, after which the accumulated score remains displayed.

The predetermined time may be capable of being varied by the user who can then vary the intensity of the exercise by choosing a longer predetermined time, corresponding to a less intense exercise, or a shorter predetermined time, corresponding to a more intense exercise.

According to another aspect of the invention there is provided a method whereby a person (the user) exercises his or her abdominal muscles according to which the person lies in front of apparatus including a visual display having a plurality of elements which are individually illuminated, sits up as each element is illuminated and places a hand in proximity to the illuminated element, preferably so as to cause the element to return to its non-illuminated state, the person then return to the lying position ready for the next sit-up.

BRIEF DESCRIPTION OF THE DRAWINGS

Apparatus according to the invention will no be described, by way of example, with reference to the accompanying drawings, in which.

DETAILED DESCRIPTION OF THE DRAWINGS

Figure 1:
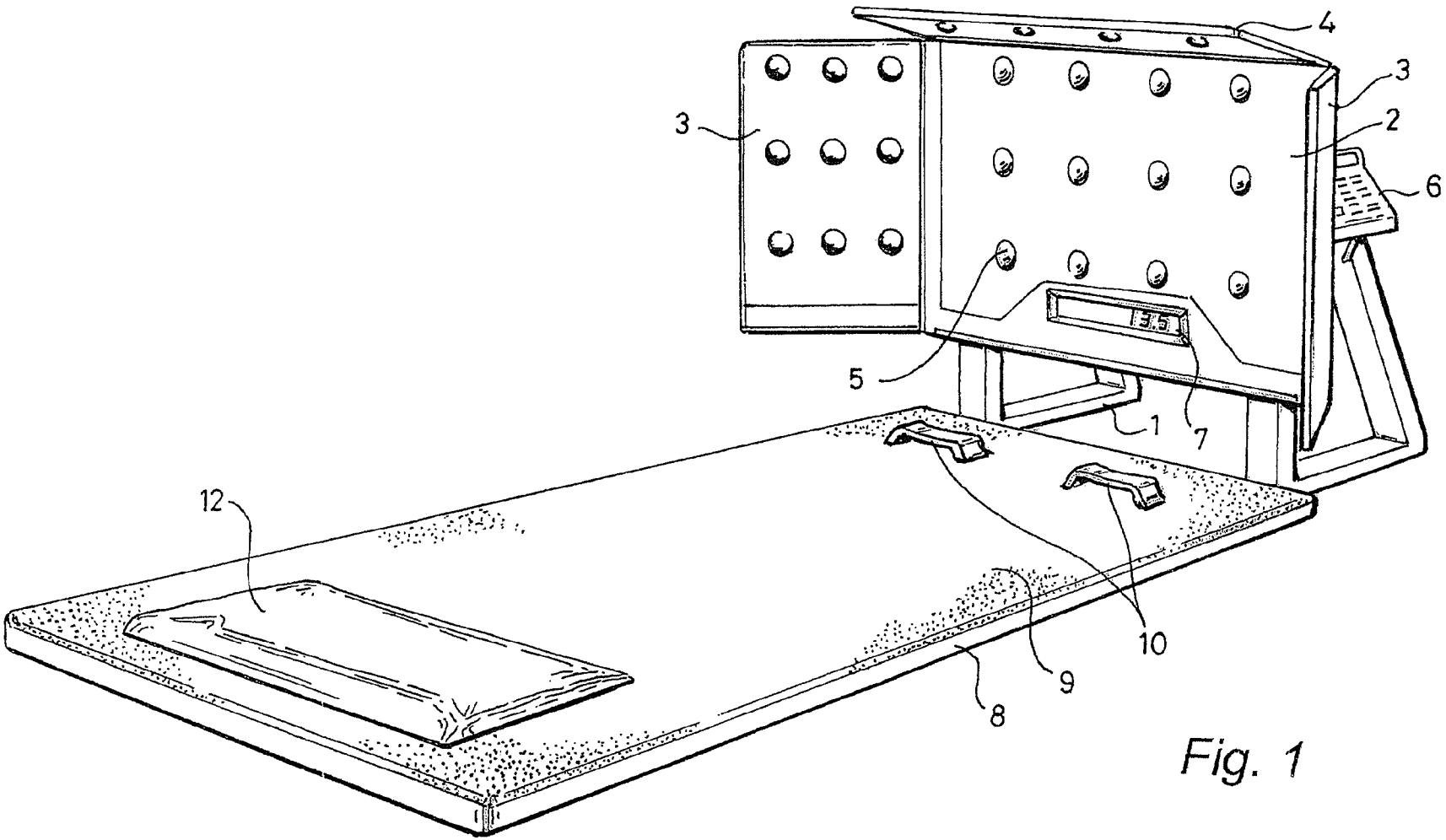
FIG. 1 is a perspective view of the apparatus.

Referring initially to FIG. 1, the apparatus comprises a frame 1 to which is rigidly attached a display panel 2 to the side edges of which are hinged two side panels 3 and to the top of which is hinged a top panel 4. The side panels 3 and the top panel 4 fold against the main panel 2 for storage or transport of the apparatus, being unfolded for use as illustrated in FIG. 1. The main panel 2 has a rectangular array of twelve touch-sensitive lights 5, and each side panel and upper panel may have further lights but the present embodiment of apparatus functions with the rectangular array of twelve lights 5.

At its rear, the frame 1 supports a control panel 6 with various key pads and a rotary switch to be described subsequently.

An alpha-numeric display 7 is positioned in a cut-out in the main panel beneath the twelve touch-sensitive lights 5.

A panel 8 extends from the front of the frame 1 to which the panel 8 is detachably secured. The upper surface of the panel 8 is covered by a rubber mat 9. Two footholds 10 project from the panel surface at the end of the panel adjacent the frame 1 and there is a padded headrest 12 adjacent the end of the panel remote from the frame.

In use, a person sets the apparatus, initially using the rotary switch previously described. The switch has four positions, off, easy, medium and hard. In the off position, the display 7 shows the last score. If the user selects easy, the display 7 is re-set to zero and there is a five second delay, giving the user the chance to lie down on the mat, head on the headrest 12 and feet inside the footholds 10. After the five second delay, one of the lights 5 is illuminated by the control circuitry of the apparatus, prompting the user to sit up, touch the illuminated light 5 with his or her hand (which causes the light to become extinguished), and then revert to the lying position, ready for the illumination of the next light. If the user touches the illuminated light 5 within a predetermined time interval (2 seconds in the easy exercise level), the score shown by the display 7 is increased by 1 but if the user fails to touch the illuminated light 5 within this predetermined time interval no increment is added to the user's score. The lights 5 are illuminated by the control circuitry in a random order, introducing a degree of interest to the exercise regime.

If the user selects medium, the predetermined time interval is 1½ seconds, and if the user selects hard the predetermined time interval is 1 second, the remaining operations being as previously described.

Figure 2:
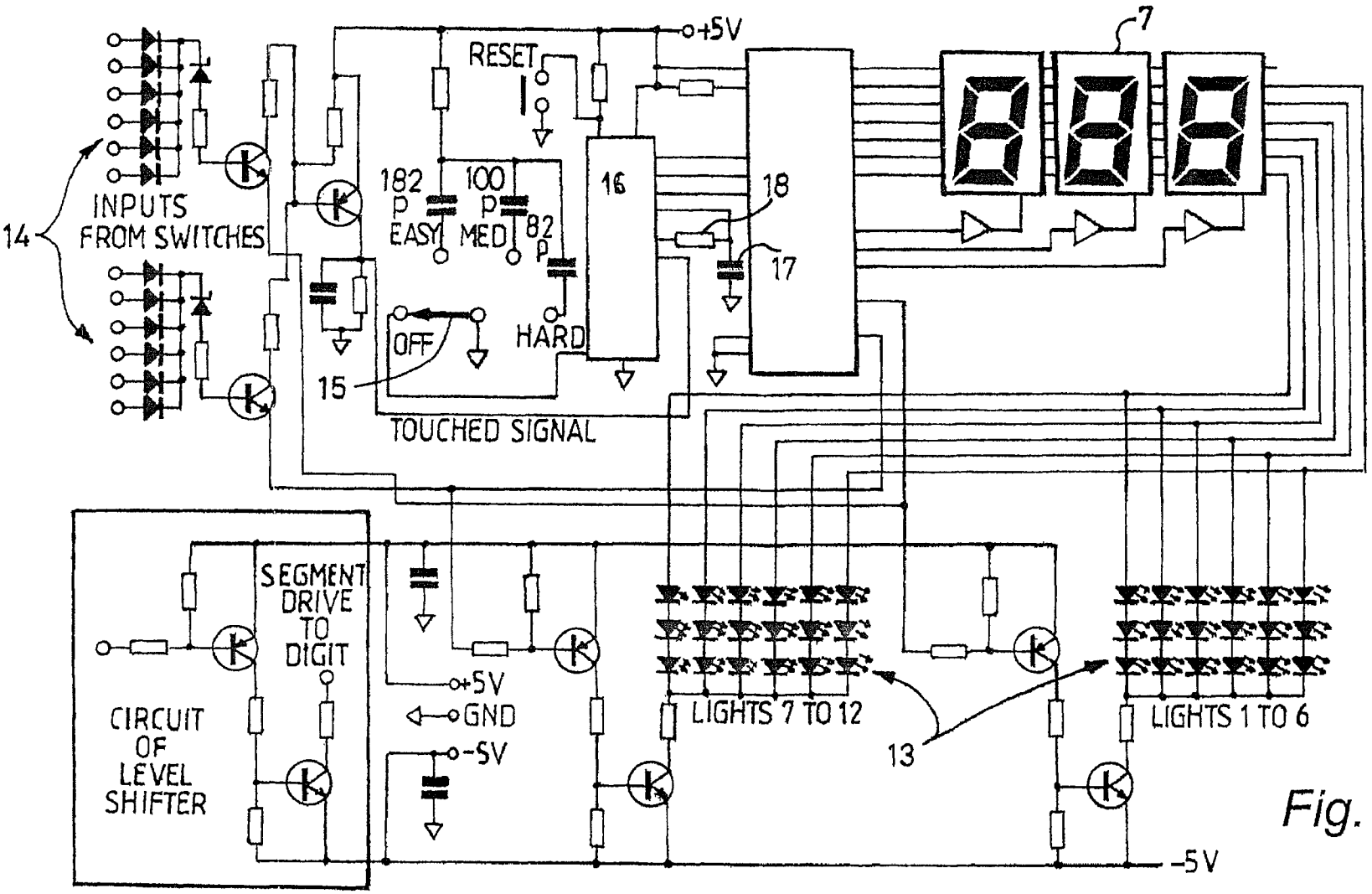
FIG. 2 is an electrical circuit diagram of the apparatus.

FIG. 2 shows twelve light emitting diodes 13 (providing the illumination for the lights 5), their associated touch-sensitive switches being shown at 14. FIG. 2 also shows the three 7-segment LEDs constituting the display 7. The rotating switch is shown at 15. The switch 15 has four alternative positions respectively marked off, easy, medium and hard, as previously described.

The circuitry includes a microprocessor 16 and a random number is generated by setting one of the digital outputs of the microprocessor high, and allowing this voltage to charge a capacitor 17 via a current limiting resistor 18. During this time, a counter is free running. An on-board analogue to digital converter measures the capacitor voltage at frequent intervals. When this voltage reaches a certain threshold, the free-running counter is stopped. The counter will now have a large number in it. The most significant part of this number is now discarded, leaving a remainder from 0-11, which is used to illuminate one of the twelve touch-sensitive lights 5 which are thus illuminated in a repetitive but random sequence, up to a total number of one hundred.

The timing for the three difficulty levels (easy, medium and hard) is effected by controlling the clock frequency of the microprocessor. Extra capacitors 19 are added across the initial timing capacitor to slow the clock. The 1, 1½ and 2 second timing delays are then generated by software counting loops.

A counter is used to count the user's score. If the user touches the touch-sensitive switch 14 within the predetermined time period, an increment of 1 is added to the least significant digit held in the counter. The digit is then tested to see if it has reached 10. If it has, the counter is cleared and 1 is added to the next digit. This digit is tested likewise and so on. When the exercise is complete the display is left showing until the next exercise cycle is started.

The invention claimed is:

1. Apparatus for exercising the abdominal muscles, comprising: a microprocessor control, a visual display having a plurality of elements each of which is capable of individual illumination responsive to signals from the microprocessor control, and a detector for detecting a hand or part thereof touching an illuminated one of the plurality of elements, the detector having a device to return the illuminated one of the plurality of elements to a non-illuminated state in response to:

(a) detection by the detector of a hand or part thereof touching the illuminated element; and/or (b) a signal from the microprocessor control which is emitted after the element has been illuminated for a predetermined length of time;

wherein the microprocessor control is programmed to provide a variable frequency of illumination and/or a predetermined time interval which can be adjusted; the microprocessor control comprising control circuitry which controls the illumination of the elements such that they are illuminated in a random sequence;

the apparatus being configured to permit a user positioned in front of the display to perform a sit-up from an initial position as each element is illuminated, touch with a hand or part thereof the illuminated element and then return to the initial position, ready for a next sit-up, the apparatus further comprising a foothold to hold the feet of the user in place during exercise.

2. Apparatus according to claim 1, wherein the foothold comprises two footholds.

3. Apparatus according to claim 1, wherein the foothold comprises: one or two bars under which the feet of the user can be placed; or one or two straps to hold the feet of the user in place; or shaped or moulded recesses in a foot-retaining member to accommodated the feet of the user.

4. Apparatus according to claim 1, wherein the detector detects the user's hand or part thereof touching an illuminated element capacitatively or optically.

5. Apparatus according to claim 1, wherein the microprocessor control determines the elapsed time between the onset of illumination of each element and the user's hand or part thereof touching the illuminated element, compares the elapsed time with a predetermined allowed time interval and, if the elapsed time is less than the predetermined allowed time interval, accords a score so that the accumulated score is representative of the total number of times the user has completed a sit-up within the allowed time interval.

6. Apparatus according to claim 1, wherein the intensity of the exercise may be varied.

7. Apparatus according to claim 6, wherein the intensity of the exercise may be varied by altering the frequency of illumination of the elements and/or by varying the predetermined allowed time interval in the apparatus.

* * * * *